US009597712B2

(12) United States Patent
Kozawa et al.

(10) Patent No.: US 9,597,712 B2
(45) Date of Patent: Mar. 21, 2017

(54) POWDER CLASSIFYING APPARATUS

(71) Applicant: NISSHIN SEIFUN GROUP INC., Tokyo (JP)

(72) Inventors: Kazumi Kozawa, Fujimino (JP); Kenji Jikihara, Fujimino (JP); Shunsuke Yamamoto, Tokyo (JP)

(73) Assignee: NISSHIN SEIFUN GROUP INC., Tokyo (JP)

( * ) Notice: Subject to any disclaimer, the term of this patent is extended or adjusted under 35 U.S.C. 154(b) by 0 days.

(21) Appl. No.: 14/903,016

(22) PCT Filed: Jun. 5, 2014

(86) PCT No.: PCT/JP2014/064972

§ 371 (c)(1),
(2) Date: Jan. 5, 2016

(87) PCT Pub. No.: WO2015/001905

PCT Pub. Date: Jan. 8, 2015

(65) Prior Publication Data

US 2016/0151806 A1 Jun. 2, 2016

(30) Foreign Application Priority Data

Jul. 5, 2013 (JP) ..... 2013-141819

(51) Int. Cl.
*B07B 7/086* (2006.01)
*B07B 7/10* (2006.01)

(52) U.S. Cl.
CPC ..... *B07B 7/086* (2013.01); *B07B 7/10* (2013.01)

(58) Field of Classification Search
CPC .. B07B 7/08; B07B 7/086; B07B 7/10; B07B 11/02; B07B 11/06
See application file for complete search history.

(56) References Cited

U.S. PATENT DOCUMENTS 2,616,563 A * 11/1952 Hebb ..... B04C 1/00 209/135
3,048,271 A * 8/1962 Sharples ..... B07B 7/08 209/135

(Continued)

FOREIGN PATENT DOCUMENTS

JP 2007-862 A 1/2007
JP 2009-34560 A 2/2009

(Continued)

*Primary Examiner* — Joseph C Rodriguez
(74) *Attorney, Agent, or Firm* — Muncy, Geissler, Olds & Lowe, P.C.

(57) ABSTRACT

A powder classifying apparatus for classifying powder that has a granularity distribution and recovering fine powder has: a casing provided with two disc-shaped members and a surrounding wall member, a disc-shaped hollow section for classifying powder using a spinning airflow in the interior thereof being formed on the inner side of the casing; at least one powder supply opening for supplying powder into the disc-shaped hollow section; a discharge section for discharging air including fine powder discharged from the disc-shaped hollow section; a recovery unit formed in the thickness-wise center of the surrounding wall member of the casing and provided with a slit-shaped opening for recovering coarse powder discharged from the disc-shaped hollow section; and two air introduction units provided with a plurality of air introduction devices for introducing air into the disc-shaped hollow section in order to form the rotational airflow inside the disc-shaped hollow section.

11 Claims, 8 Drawing Sheets

(56) References Cited

U.S. PATENT DOCUMENTS

| | | | | |
|---|---|---|---|---|
| 4,793,917 | A * | 12/1988 | Eremin | B07B 7/083 209/143 |
| 5,931,305 | A * | 8/1999 | Akiyama | B07B 7/083 209/139.2 |
| 6,260,708 | B1 * | 7/2001 | Adam | B07B 7/083 209/132 |
| 6,276,534 | B1 * | 8/2001 | Huang | B07B 7/083 209/139.2 |
| 8,668,090 | B2 * | 3/2014 | Taketomi | B07B 4/02 209/135 |
| 9,050,630 | B2 * | 6/2015 | Kozawa | B07B 4/08 |
| 9,415,421 | B2 * | 8/2016 | Kozawa | B07B 7/08 |
| 2010/0270214 | A1 | 10/2010 | Taketomi et al. | |

FOREIGN PATENT DOCUMENTS

| | | | |
|---|---|---|---|
| JP | 2011-045819 | A | 3/2011 |
| WO | WO 2012/066885 | A1 | 5/2012 |

* cited by examiner

POWDER CLASSIFYING APPARATUS

TECHNICAL FIELD

The present invention relates to a powder classifying apparatus that classifies powder having a particle size distribution according to a desired diameter (classification point) and, in particular, to a powder classifying apparatus capable of accurately classifying powder ranging preferably from about several micrometer size to about submicron size using a balance between a centrifugal force imparted to the powder by a whirling gas stream and a drag over long periods of time.

BACKGROUND ART

There has been conventionally known a classifying apparatus that uses guide vanes or air nozzles to generate a whirling gas stream in a classifying chamber to impart a whirling motion to powder supplied into the classifying chamber for separating the powder into fine powder and coarse powder by a centrifugal force, the fine powder being collected from the central part of the whirling gas stream and the coarse powder being collected from a lower peripheral portion of the whirling gas stream.

Aside from that, in recent years, with the advancement in technology of electronic components and the like such as a capacitor, there is demand for fine particles having a narrow particle size distribution.

To cope with it, for instance, in Patent Literature 1, the applicant proposes a powder classifying apparatus in which a disc-like cavity serving as a classifying site for centrifuging powder having a particle size distribution is formed between two disc-like members; a plurality of guide vanes are arranged at an outer periphery of the disc-like cavity so as to extend from the outer periphery of the disc-like cavity toward an inner direction at a predetermined angle; a powder supply port for supplying the powder to the disc-like cavity is disposed at an upper disc-like member; a discharge unit for air streams including fine powder discharged from the central part of the disc-like cavity is disposed in the central part of the upper disc-like member; a collection unit for coarse powder discharged from the disc-like cavity is disposed between a lower portion of an outer edge portion of a lower disc-like member and an outer peripheral wall of the disc-like cavity; a plurality of first air nozzles for blowing compressed air into an inside of the disc-like cavity are arranged near the powder supply port and above the plurality of guide vanes on the outer peripheral wall of the disc-like cavity so as to extend along tangential directions of the wall; and a plurality of second air nozzles for blowing compressed air into an inside of the disc-like cavity are arranged at the collection unit of coarse powder and below the plurality of guide vanes on the outer peripheral wall of the disc-like cavity so as to extend along tangential directions of the wall.

With this configuration, the powder classifying apparatus disclosed in Patent Literature 1 sucks and discharges air through the discharge unit by use of a blower to cause air sucked from the outside of the apparatus to pass through the guide vanes to thereby form a whirling gas stream in the disc-like cavity which serves as a centrifuge chamber (classifying site), thus imparting a whirling motion to the powder and separating the powder into coarse powder and fine powder by a centrifugal force. At this time, the apparatus blows compressed air into the inside of the disc-like cavity through the first air nozzles to cause the powder supplied from the powder supply port to join the whirling gas stream and blows compressed air to the lower portion of the outer edge portion of the disc-like cavity through the second air nozzles to return, to the disc-like cavity, fine powder mixed in coarse powder to be collected through a coarse powder collection port, thereby accurately sorting out fine powder of up to about several micrometers or submicron size.

As a result, in Patent Literature 1, the powder classifying apparatus is attained which can accurately sort out (classify) fine powder of up to about several micrometers or submicron size, enables easy control of the particle size, and allows easy maintenance.

Besides, for instance, in Patent Literature 2, the applicant proposes a powder classifying apparatus in which formed in a casing are a disc-like centrifuge chamber for centrifuging powder having a particle size distribution, and a ring-shaped powder dispersion chamber and a ring-shaped powder reclassifying chamber which are located separately at the opposite sides of the centrifuge chamber to be coaxial therewith and to communicate with the centrifuge chamber; the outer peripheral portion of the centrifuge chamber is closed by a peripheral wall; formed at the casing are a powder supply port for supplying powder into the powder dispersion chamber, a fine powder discharge port for discharging air stream including fine powder from the centrifuge chamber, and a coarse powder discharge port for discharging coarse powder from the powder reclassifying chamber; a plurality of first air nozzles for ejecting compressed air into the inside of the powder dispersion chamber and a plurality of second air nozzles for ejecting compressed air into the inside of the powder reclassifying chamber are arranged on the peripheral wall of the casing along a circumferential direction thereof to generate a first whirling gas stream for dispersing the powder in the powder dispersion chamber and a second whirling gas stream for allowing fine powder mixed in coarse powder in the powder reclassifying chamber to float and return to the centrifuge chamber; and a third whirling gas stream is generated using the above two whirling gas streams for classifying (centrifuging) the powder having a particle size distribution in the centrifuge chamber.

With this configuration, the powder classifying apparatus disclosed in Patent Literature 2 generates the first whirling gas stream in the ring-shaped powder dispersion chamber by use of compressed air ejected from the first air nozzles to the powder dispersion chamber to allow the powder supplied through the powder supply port to be carried and dispersed by the first whirling gas stream while causing the powder to enter a disc-like cavity which serves as the centrifuge chamber and communicates with the powder dispersion chamber, and generates the second whirling gas stream in the ring-shaped powder reclassifying chamber by use of compressed air ejected from the second air nozzles to the powder reclassifying chamber to allow fine powder mixed in coarse powder to float and return to the centrifuge chamber while causing the floating fine powder to enter the disc-like cavity which serves as the centrifuge chamber and communicates with the powder reclassifying chamber, whereby the third whirling gas stream for classifying the powder is generated in the disc-like cavity to impart a whirling motion to the powder and separate the powder into coarse powder and fine powder by a centrifugal force, thereby accurately sorting out fine powder of up to about several micrometers or submicron size.

As a result, Patent Literature 2 enables fine particles to be accurately sorted out.

Patent Literature 1: JP 2009-34560 A

Patent Literature 2: JP 2011-45819 A

SUMMARY OF INVENTION

Technical Problems

Meanwhile, in order to deal with much finer powder in recent years, it is required to form much stronger whirl (whirling gas stream) in a disc-like cavity serving as a classifying site.

In the powder classifying apparatus disclosed in Patent Literature 1, however, since the whirling gas stream used for centrifugation is generated in the disc-like cavity serving as the classifying site by use of air which has passed through the guide vanes due to suction by the blower, and the inflow velocity of air entering through the guide vanes is far lower than that of air being ejected and entering from the air nozzles, even if the inflow velocity of air entering through the guide vanes is increased, the resulting increase in flow rate of the whirling gas stream for use in classification (centrifugation) is not enough, so that finer particles requiring a high flow rate of whirling gas stream cannot be sorted out, disadvantageously.

Therefore, in the powder classifying apparatus disclosed in Patent Literature 1, it is necessary to considerably increase the amount of compressed air to be ejected from the first air nozzles. When a great amount of air is sucked through the conventional guide vanes, whirl (whirling gas stream) to be generated in the disc-like cavity serving as the classifying site is uniform. However, as the amount of air ejected from the first air nozzles is increased, the whirl (whirling gas stream) gets nonuniform accordingly, and as shown in FIGS. 8(C) and 8(D), powder is adhered to an upper wall surface of the disc-like cavity (a lower wall surface of the upper disc-like member) or a lower wall surface of the same (an upper wall surface of the lower disc-like member), resulting in great deterioration of classification accuracy. Such adhered powder increases with increasing periods of time of the classification operation, which may cause detachment of the adhered powder or the like, leading to such problems as deteriorated classification accuracy and mixing of coarse particles.

In the powder classifying apparatus disclosed in Patent Literature 2, since the third whirl (whirling gas stream) is generated by the first and second whirls (whirling gas streams) generated by compressed air ejected from the first and second air nozzles, the amount of air in the third whirl (whirling gas stream) can be further increased compared to the powder classifying apparatus disclosed in Patent Literature 1. When, however, the amount of compressed air ejected from the first or second air nozzles is increased to sort out much finer particles, as with the case of the powder classifying apparatus disclosed in Patent Literature 1, the whirl (whirling gas stream) gets nonuniform, leading to deterioration of dispersion accuracy, and powder may be adhered to an upper wall surface of the disc-like cavity (a lower wall surface of an upper disc-like member), resulting in great deterioration of classification accuracy.

The object of the present invention is to solve the above problems of the conventional art and provide a powder classifying apparatus that can generate an uniform whirling gas stream in a disc-like cavity serving as a classifying site and maintain the uniform whirling gas stream over long periods of time to thereby accurately sort out fine powder of up to about several micrometers or submicron size over long periods of time without allowing powder to adhere to a wall surface of the disc-like cavity, particularly to an upper or lower wall surface thereof.

Solution to Problems

In order to attain the above objects, the present invention provides a powder classifying apparatus for classifying powder having a particle size distribution to collect fine powder having a size not larger than a predetermined particle size, comprising: a casing including two disc-like members arranged to be spaced apart at a predetermined interval and a peripheral wall member attached on outer peripheral sides of the two disc-like members, the casing having therein a disc-like cavity formed between the two disc-like members and at an inner side of the peripheral wall member, the disc-like cavity being a place where the powder is classified by a whirling gas stream generated therein; one or more powder supply ports disposed at an outside of at least one of the two disc-like members of the casing so as to communicate with an inner side of an outer edge portion of the disc-like cavity, and configured to supply the powder conveyed by air flow into the disc-like cavity; a discharge section formed at at least one of the two disc-like members of the casing so as to communicate with a central portion, in a radial direction, of the disc-like cavity, and configured to discharge air containing the fine powder to be discharged from the disc-like cavity; a collecting section formed at a middle portion, in a thickness direction, of the peripheral wall member of the casing so as to communicate with the outer edge portion of the disc-like cavity, and including a slit-type opening provided to collect coarse powder having a size larger than the predetermined particle size to be discharged from the disc-like cavity; and two air introducing sections separately provided at opposite sides, in the thickness direction, of the slit-type opening of the peripheral wall member of the casing, each including a plurality of air introducing devices arranged at the peripheral wall member of the casing at the outer edge portion of the disc-like cavity to extend along tangential directions of the outer edge portion, the plurality of air introducing devices being configured to introduce air into the disc-like cavity to generate the whirling gas stream in the disc-like cavity.

Preferably, the two disc-like members comprise an upper disc-like member and a lower disc-like member, and the powder classifying apparatus further includes a second collecting section formed at at least one of the two disc-like members of the casing so as to communicate with the disc-like cavity, the second collecting section being configured to collect a part of the coarse powder discharged from the disc-like cavity.

Preferably, the discharge section is composed of an inner cylindrical tube standing upright through the upper disc-like member of the casing and having an end projecting toward an inside of the disc-like cavity, the second collecting section is composed of an outer cylindrical tube with a diameter larger than that of the inner cylindrical tube, the outer cylindrical tube standing upright through the upper disc-like member of the casing and being disposed coaxially with the inner cylindrical tube, and an end of the outer cylindrical tube is positioned above the end of the inner cylindrical tube and communicates with the disc-like cavity.

Alternatively, the second collecting section preferably includes a groove-shaped discharge path formed at a lower side of the lower disc-like member of the casing so as to communicate with the inner side of the outer edge portion of the disc-like cavity.

Preferably, the slit-type opening of the collecting section has a taper shape that widens toward the disc-like cavity.

Preferably, the discharge section is provided at each of the two disc-like members of the casing.

It is preferable to further include a ring-shaped edge disposed at a center of at least one of opposing inner surfaces of the two disc-like members of the casing, the opposing inner surfaces constituting an upper surface and a lower surface of the disc-like cavity.

Preferably, the powder supply ports are evenly arranged at the upper disc-like member of the two disc-like members of the casing and are inclined toward the inner side of the outer edge portion of the disc-like cavity along a whirling direction of the whirling gas stream, and the powder is conveyed by air flow generated by an ejector, and ejected and supplied with the air flow from the powder supply ports into the disc-like cavity in the whirling direction of the whirling gas stream.

Preferably, the powder supply port opens to an inside of one of the air introducing devices of one of the two air introducing sections, and the powder is conveyed by air flow by an ejector effect that occurs owing to air introduced by the one of the air introducing devices and is supplied to the disc-like cavity.

Preferably, the powder to be conveyed by air flow is distributed in advance by a distributor to a plurality of pipelines each connected to each of the powder supply ports by aid of compressed air.

Preferably, each of the air introducing devices is an air nozzle for use in injecting compressed air into the disc-like cavity.

Advantageous Effects of Invention

According to the present invention, there can be achieved the powder classifying apparatus that can generate an uniform whirling gas stream in a disc-like cavity serving as a classifying site and maintain the uniform whirling gas stream over long periods of time to thereby accurately sort out fine powder of up to about several micrometers or submicron size over long periods of time without allowing powder to adhere to a wall surface of the disc-like cavity, particularly to an upper or lower wall surface thereof, and that also enables easy control of the particle size and allows easy maintenance.

DESCRIPTION OF EMBODIMENTS

The powder classifying apparatus of the invention will be now described in detail based on preferred embodiments illustrated in the attached drawings.

First Embodiment

Figure 1:
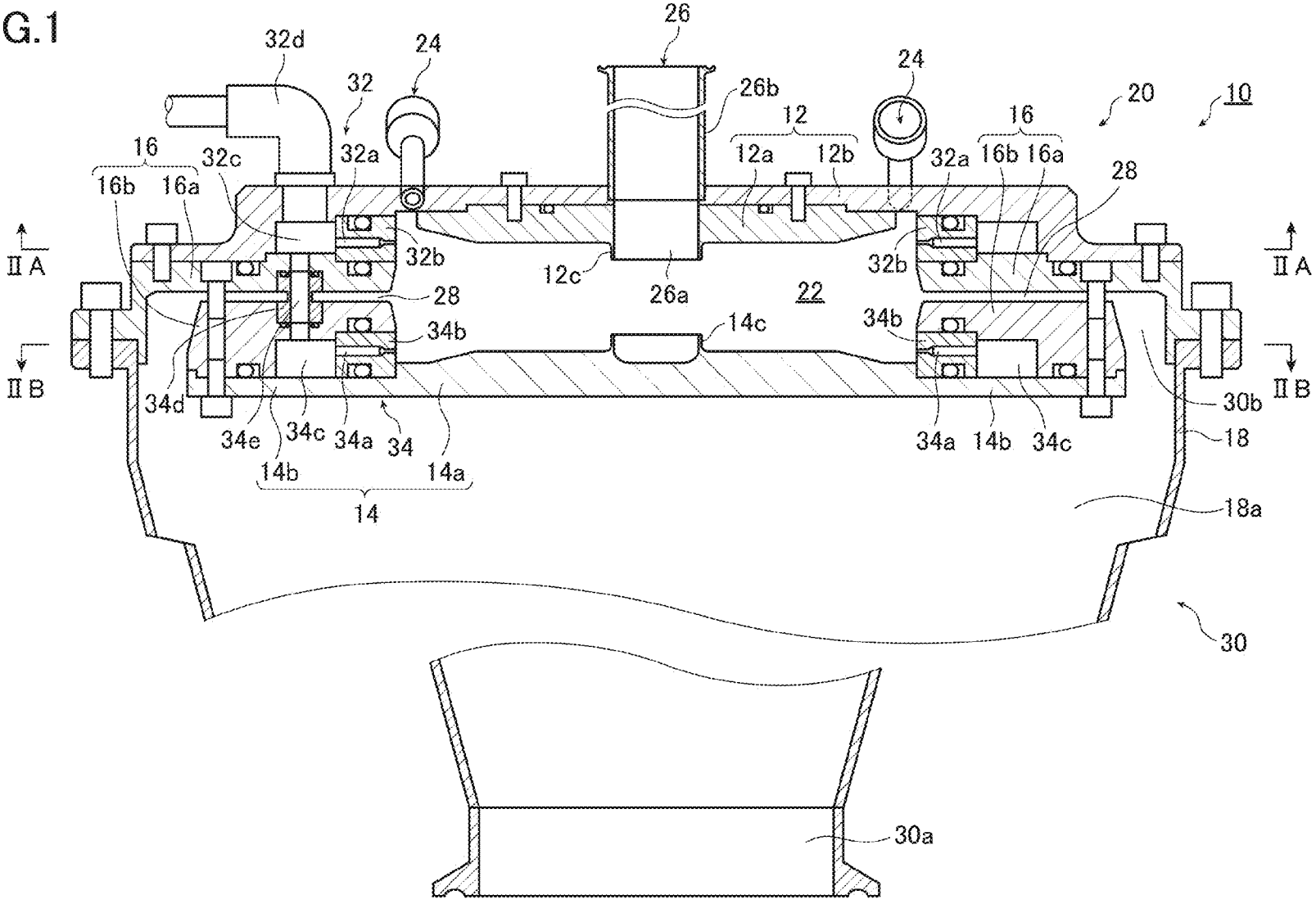
FIG. 1 is a cross-sectional view schematically showing a configuration of a powder classifying apparatus according to an embodiment of the invention.

FIG. 1 is a cross-sectional view schematically showing a configuration of the powder classifying apparatus according to a first embodiment of the invention along a plane extending through the central axis of the powder classifying apparatus.

Figure 2A:
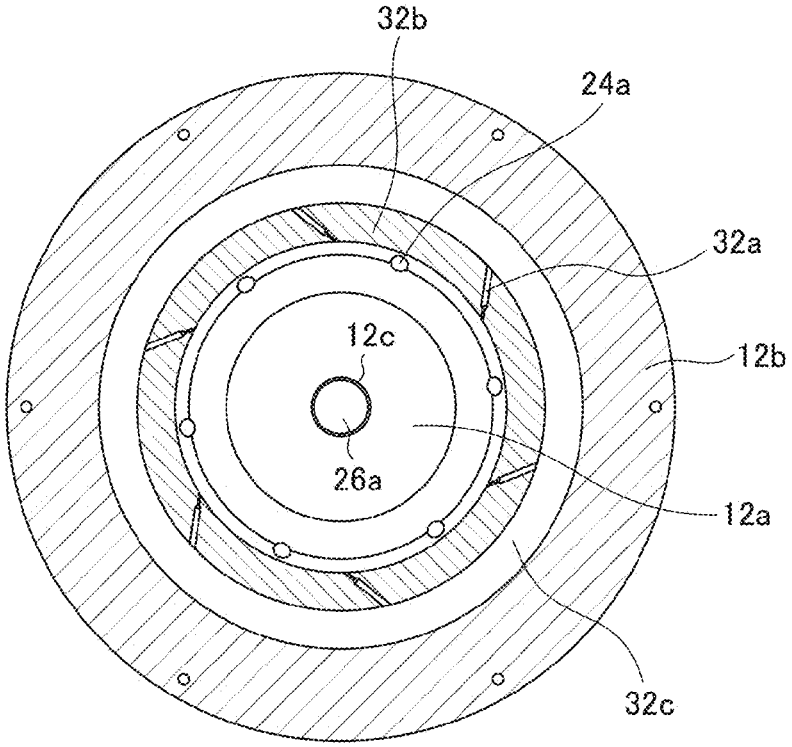
FIGS. 2(A) and 2(B) are cross-sectional views taken along lines IIA-IIA and IIB-IIB of the powder classifying apparatus shown in FIG. 1, respectively.
Figure 2B:
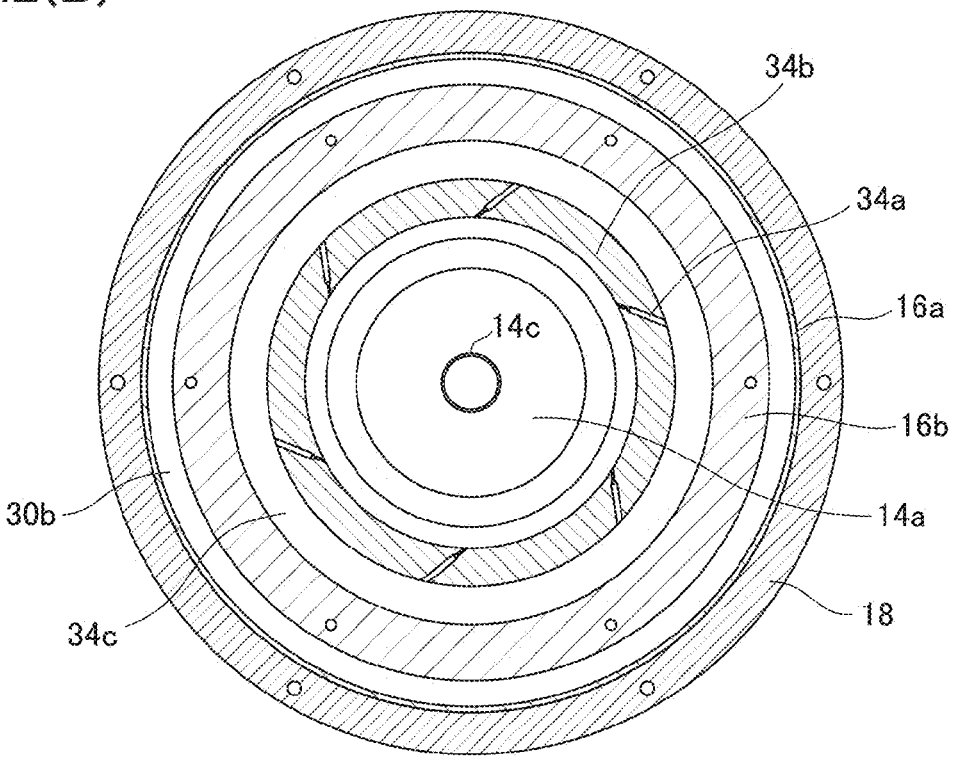

FIGS. 2(A) and 2(B) are cross-sectional views taken along lines IIA-IIA and IIB-IIB of the powder classifying apparatus shown in FIG. 1, respectively.

A powder classifying apparatus 10 in the first embodiment of the invention shown in FIG. 1 includes a casing 20 of substantially truncated cone shape with the top being oriented vertically downward. The casing 20 includes an upper disc-like member 12 and a lower disc-like member 14 that are arranged to face each other at a predetermined interval, an annular peripheral wall member 16 attached to the outer peripheries of the two disc-like members 12 and 14, and a cone member 18 attached to a lower portion of the peripheral wall member 16. A centrifuge chamber 22 constituted of a disc-like cavity which is substantially vertically symmetric is formed between the two disc-like members 12 and 14 and in the inside of the peripheral wall member 16.

As shown in FIGS. 1 and 2(A), the powder classifying apparatus 10 includes: a powder supply section 24 made up of a plurality of, e.g., six powder supply ports 24*a* evenly arranged on a circle having a predetermined radius from the center of the upper disc-like member 12 so as to communicate with the inner side of an outer edge portion of an upper portion of the centrifuge chamber 22; a fine powder collecting section 26 having a fine powder collecting port 26*a* located at the center of the upper disc-like member 12 so as to communicate with the center portion of the upper portion of the centrifuge chamber 22 for collecting, together with air, fine powder having a size not larger than a predetermined particle size (classification point); a coarse powder collecting section 30 having a slit-type annular opening 28 located at the middle, in the vertical direction, of the peripheral wall member 16 so as to communicate with a middle portion, in the vertical direction, of the outer edge portion of the centrifuge chamber 22 for collecting coarse powder having a size larger than the predetermined particle size (classification point); and first and second air introducing sections 32 and 34 that are arranged at the opposite sides, in the vertical direction, of the annular opening 28 of the peripheral wall member 16, each of the air introducing sections 32 and 34 being composed of a plurality of, e.g., six air nozzles 32*a* or 34*a*. The fine powder collecting section 26 and the coarse powder collecting section 30 constitute a discharge section and a collecting section of the invention, respectively, and the first air introducing section 32 and the second air introducing section 34 constitute air introducing devices of the invention.

The upper disc-like member 12 is composed of an inner member 12*a* and an outer member 12*b* but may be formed as a single member integrally including these members.

The inner member 12*a* is fixed to the bottom surface of the outer member 12*b* by fixing members such as bolts or screws and supported thereby. The bottom surface of the inner member 12*a* constitutes the upper surface of the centrifuge chamber 22. The bottom surface of the inner member 12*a* is inclined upward in the vicinity of the outer peripheral portion and accordingly, the upper surface of the centrifuge chamber 22 is inclined upward in the vicinity of the outer edge portion.

A ring-shaped edge portion 12*c* is formed at the center of the inner member 12*a* and at an opening end of the fine powder collecting port 26*a* facing the centrifuge chamber 22 to project toward the centrifuge chamber 22. The fine powder collecting port 26*a* is constituted of a circular hole at the center of the inner member 12*a* and a cylindrical tube 26*b* disposed at the center of the outer member 12*b*, and is connected to a suction blower 92 (see FIG. 7) via an appropriate fine powder collecting filter 90 (see FIG. 7) such as a bag filter. Consequently, air containing fine powder having been sorted out in the centrifuge chamber 22 is sucked by the suction blower 92 and discharged through the fine powder collecting port 26*a*.

The plurality of, e.g., six powder supply ports 24*a* are evenly arranged at an annular region of the outer member 12*b* between an outer peripheral edge portion of the inner member 12*a* and an inner peripheral edge portion of the peripheral wall member 16, i.e., on a circle having a predetermined radius from the center of the upper member 12*b* as described above. The powder supply ports 24*a* are disposed along a whirling direction of a whirling gas stream in the centrifuge chamber 22 to be oriented from the outside of the upper disc-like member 12 (outer member 12*b*) to the inside of the centrifuge chamber 22 and to be inclined with respect to the top surface of the upper disc-like member 12 (outer member 12*b*).

The powder supply ports 24*a* are arranged to be located at respective plural positions at regular intervals inside the outer edge portion of the centrifuge chamber 22 so that powder conveyed from a distributor 84 (see FIG. 7) by means of a flow of compressed air is caused to join a whirling gas stream in the centrifuge chamber 22 in the whirling direction of the whirling gas stream. In other words, the powder conveyed by air flow is supplied or preferably ejected evenly from the plural positions in the same direction as the whirling direction of the whirling gas stream, i.e., in tangential directions of the whirling gas stream in the centrifuge chamber 22. Consequently, compared with a conventional apparatus in which powder is supplied from a powder supply port in a direction perpendicular to the whirling direction of a whirling gas stream (supplied vertically downward) and the whirling gas stream is greatly disturbed in a centrifuge chamber accordingly, the disturbance of the whirling gas stream in the centrifuge chamber 22 caused by supply of powder from the powder supply ports 24*a* can be minimized.

The lower disc-like member 14 is composed of an inner edge portion 14*a* having an inner surface (top surface) which is substantially symmetrical to the inner member 12*a* of the upper disc-like member 12, and an outer edge portion 14*b* fixed at and supported by a lower peripheral wall member 16*b* of the peripheral wall member 16 to be described later. The top surface of the inner edge portion 14*a* is inclined downward in the vicinity of the outer peripheral portion in a symmetrical manner with respect to the bottom surface of the inner member 12*a*, and accordingly, the bottom surface of the centrifuge chamber 22 is inclined downward in the vicinity of the outer edge portion.

Thus, the centrifuge chamber 22 is a disc-like cavity that is substantially symmetrical in the vertical direction.

A ring-shaped edge portion 14*c* is formed at the center of the inner edge portion 14*a* of the lower disc-like member 14 to project toward the centrifuge chamber 22 and face the ring-shaped edge portion 12*c* formed at the center of the inner member 12*a* of the upper disc-like member 12. In other words, the edge portions 12*c* and 14*c* are arranged to face each other across the centrifuge chamber 22.

The ring-shaped edges portions 12*c* and 14*c* are factors determining the classification performance of the powder classifying apparatus 10, and the attachment positions, the ring sizes and the edge heights thereof need to be set according to the type of powder to be classified, the type of fine powder to be collected, or the like. However, the present invention is not limited to the illustrated example.

While the ring-shaped edge portions 12*c* and 14*c* are arranged to face each other across the centrifuge chamber 22 in the illustrated example, only one of the edge portions 12*c* and 14*c* may be provided.

The peripheral wall member 16 is composed of an upper peripheral wall member 16*a* and the lower peripheral wall member 16*b* which are fixed by fixing members such as bolts at a predetermined interval. The upper peripheral wall member 16*a* has a top surface fixed to the bottom surface of the outer member 12*b* of the upper disc-like member 12 by fixing members such as bolts and supported thereby, and a bottom surface to and by which the top surface of the cone member 18 is fixed by fixing members such as bolts and supported. The lower peripheral wall member 16*b* has a bottom surface to and by which the outer edge portion 14*b* of the lower disc-like member 14 is fixed by fixing members such as bolts and supported. The configurations of the upper disc-like member 12, the lower disc-like member 14, the peripheral wall member 16 and the cone member 18 and the fixing and supporting states are not limited to the illustrated example.

The slit-type annular opening 28 connected to a coarse powder collecting port 30*a* of the coarse powder collecting section 30 is formed between the upper and lower peripheral wall members 16*a* and 16*b* fixed to be spaced apart at a predetermined interval.

The slit-type annular opening 28 is located at the middle, in the vertical direction, of the outer edge portion of the centrifuge chamber 22 and therefore, coarse powder affected by a large centrifugal force in a whirling gas stream in the centrifuge chamber 22 smoothly moves to the slit-type annular opening 28 and is drawn out of the centrifuge chamber 22. Thus, coarse powder can be smoothly taken out from the centrifuge chamber 22 serving as the classifying site.

The first and second air introducing sections 32 and 34 are respectively provided at the upper and lower peripheral wall members 16*a* and 16*b* of the peripheral wall member 16 at vertically symmetrical positions with respect to the slit-type annular opening 28.

The first air introducing section 32 is composed of the plurality of, e.g., six first air nozzles 32*a* that are arranged at the inner peripheral portion of the upper peripheral wall member 16*a* adjoining the centrifuge chamber 22, so as to face the inside of the centrifuge chamber 22, while the second air introducing section 34 is composed of the plurality of, e.g., six second air nozzles 34*a* that are arranged at the inner peripheral portion of the lower peripheral wall member 16*b* adjoining the centrifuge chamber 22, so as to face the inside of the centrifuge chamber 22.

The first air nozzles 32*a* eject compressed air toward the bottom surface of the inner member 12*a* of the upper disc-like member 12 (a part where the slope of the outer periphery starts), and the second air nozzles 34*a* eject compressed air toward the top surface of the inner edge portion 14*a* of the lower disc-like member 14 (a part where the slope of the outer periphery starts).

In the first air introducing section 32, the first air nozzles 32*a* are formed at a nozzle member 32*b* and communicates with a space 32*c* that is formed by the outer member 12*b* of the upper disc-like member 12, the upper peripheral wall member 16*a* of the peripheral wall member 16, and the nozzle member 32*b* interposed between the outer member 12*b* and the upper peripheral wall member 16*a* and that serves as a compressed air gathering space. The space 32*c* communicates with a pipe 32*d* connected to the outer member 12*b*. The pipe 32*d* is further connected to a compressed air supply source 82 (see FIG. 7). The first air nozzles 32*a* are thus connected to the compressed air supply source 82.

On the other hand, in the second air introducing section 34, the second air nozzles 34*a* are formed at a nozzle member 34*b* and communicates with a space 34*c* that is formed by the outer edge portion 14*b* of the lower disc-like member 14, the lower peripheral wall member 16*b* of the peripheral wall member 16, and the nozzle member 34*b* interposed between the outer edge portion 14*b* and the lower peripheral wall member 16*b* and that serves as a compressed air gathering space. The space 34*c* communicates with the space 32*c* of the first air introducing section 32 via a through-hole 34*e* in a communication member 34*d* interposed between the upper and lower peripheral wall members 16*a* and 16*b* of the peripheral wall member 16. The through-hole 34*e* in the communication member 34*d* is of course configured so as not to communicate with the slit-type annular opening 28 between the upper and lower peripheral wall members 16*a* and 16*b*. The second air nozzles 34*a* are thus connected to the compressed air supply source 82 (see FIG. 7).

In the first air introducing section 32, as shown in FIG. 2(A), the six first air nozzles 32*a* are arranged on the outer periphery of the centrifuge chamber 22, i.e., on a predetermined circle, to be spaced apart from each other at regular intervals in a circumferential direction and to extend along tangential directions of the circle, for instance, at a predetermined angle with respect to the tangential directions.

In the same manner, in the second air introducing section 34, as shown in FIG. 2(B), the six second air nozzles 34*a* are arranged on the outer periphery of the centrifuge chamber 22, i.e., on a predetermined circle, to be spaced apart from each other at regular intervals in a circumferential direction and to extend along tangential directions of the circle, for instance, at a predetermined angle with respect to the tangential directions.

The first and second air nozzles 32*a* and 34*a* are connected to the compressed air supply source 82 (see FIG. 7) as described above, and ejection of compressed air from the first and second air nozzles 32*a* and 34*a* respectively generate symmetrical whirling gas streams whirling in the same direction at the upper and lower portions in the centrifuge chamber 22. The thus generated symmetrical whirling gas streams at the upper and lower portions in the centrifuge chamber 22 generate a whirling gas stream at the middle, in the vertical direction, of the centrifuge chamber 22, too, and consequently, a uniform whirling gas stream is generated in the whole centrifuge chamber 22.

Since the uniform whirling gas is thus generated in the whole centrifuge chamber 22, coarse powder affected by a large centrifugal force can be smoothly discharged through the slit-type annular opening 28 positioned at the middle, in the vertical direction, of the outer peripheral portion of the centrifuge chamber 22. Since coarse powder can be smoothly taken out from the centrifuge chamber 22 through the slit-type annular opening 28 as described above, a whirling gas stream generated in the centrifuge chamber 22 is not disturbed.

As shown in FIG. 2(A), the six powder supply ports 24*a* are each disposed between two adjacent air nozzles 32*a* of the six first air nozzles 32*a* to be positioned along a whirling direction of a whirling gas stream generated at the upper portion in the centrifuge chamber 22 by the six air nozzles 32*a*, i.e., to extend along tangential directions of the whirling gas stream, and are inclined downward. Due to this configuration, powder conveyed by air flow is supplied, together with air, through the six powder supply ports 24*a* from an obliquely upward position toward the same direction as the whirling direction of the whirling gas stream at the upper portion in the centrifuge chamber 22. As a result, the powder is urged to be dispersed in the whirling gas stream at the upper portion in the centrifuge chamber 22, and the disturbance of the whirling gas stream at the upper portion can be suppressed and minimized compared to the case of supplying powder by dropping the powder naturally from above in the vertical direction.

While an interior region of the centrifuge chamber 22, i.e., the disc-like cavity forms the classifying site (zone) for classifying supplied powder, it can be said that an area which receives therein compressed air ejected from the first air nozzles 32*a* at the upper portion in the centrifuge chamber 22 and which is supplied with powder doubles as a powder dispersion zone because powder supplied into the centrifuge chamber 22 is dispersed in this region. An area which receives therein compressed air ejected from the second air nozzles 34*a* at the lower portion in the centrifuge chamber 22 has a function to return powder that has not completely been classified and therefore includes both coarse and fine powders having not collected from the centrifuge chamber 22, to the upper portion in the centrifuge chamber 22.

While in the illustrated example, the six first air nozzles 32*a* and the six second air nozzles 34*a* are evenly arranged on respective circles, and the six powder supply ports 24*a* are evenly arranged so that each is disposed between two adjacent air nozzles 32*a* of the six first air nozzles 32*a*, the present invention is not limited thereto and the numbers, the arrangements and the like of the first and second air nozzles 32*a* and 34*a* and the powder supply ports 24*a* may be appropriately changed depending on the type of powder to be classified or other factors.

Figure 7:
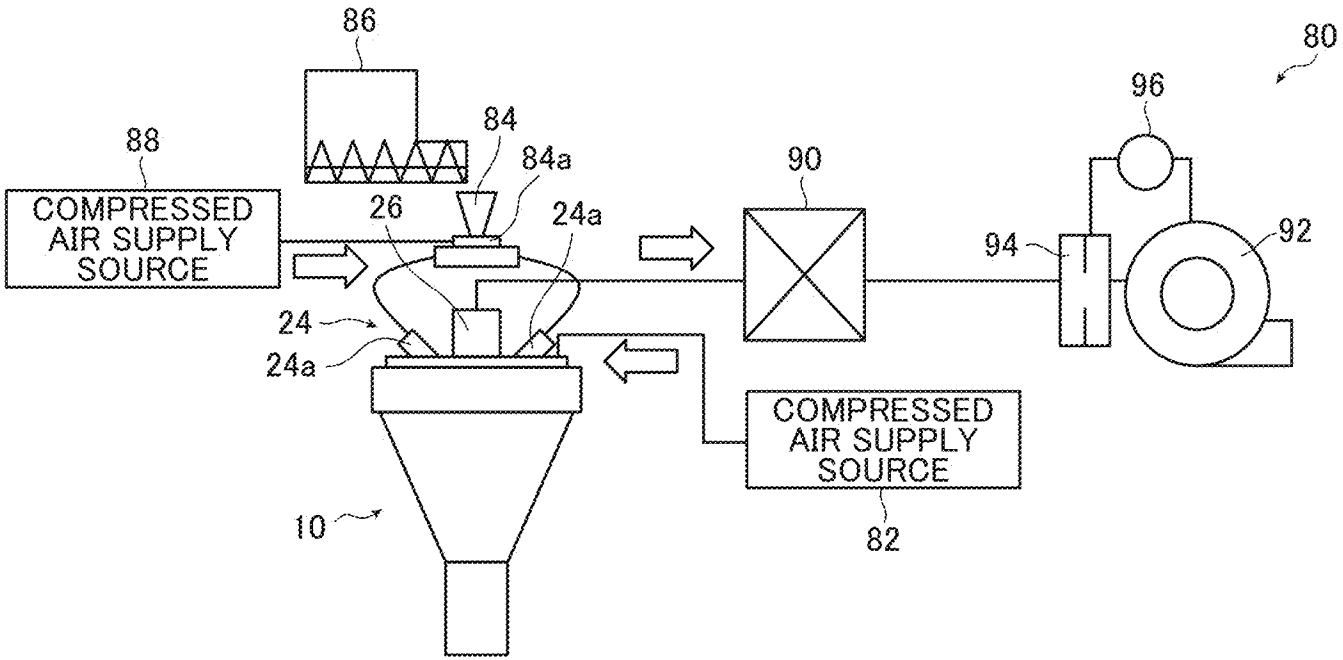
FIG. 7 is a schematic view showing a configuration of a whole classifying system using any of the powder classifying apparatuses of the invention.

As described above, the fine powder collecting section 26 includes the fine powder collecting port 26*a* constituted of the opening of the upper disc-like member 12 and the cylindrical tube 26*b*, and the cylindrical tube 26*b* is connected to the suction blower 92 via the appropriate filter 90 such as a bag filter (see FIG. 7).

The coarse powder collecting section 30 includes: the slit-type annular opening 28 between the upper and lower peripheral wall members 16*a* and 16*b* of the peripheral wall member 16; a space 30*b* that is formed between the outer peripheral wall of the lower peripheral wall member 16*b* and the inner peripheral walls of the upper peripheral wall member 16*a* and the cone member 18 and communicates with the slit-type annular opening 28; an internal space 18*a* of the cone member 18 that communicates with the space 30*b*; and the coarse powder collecting port 30*a* at an end of the cone member 18.

Figure 3:
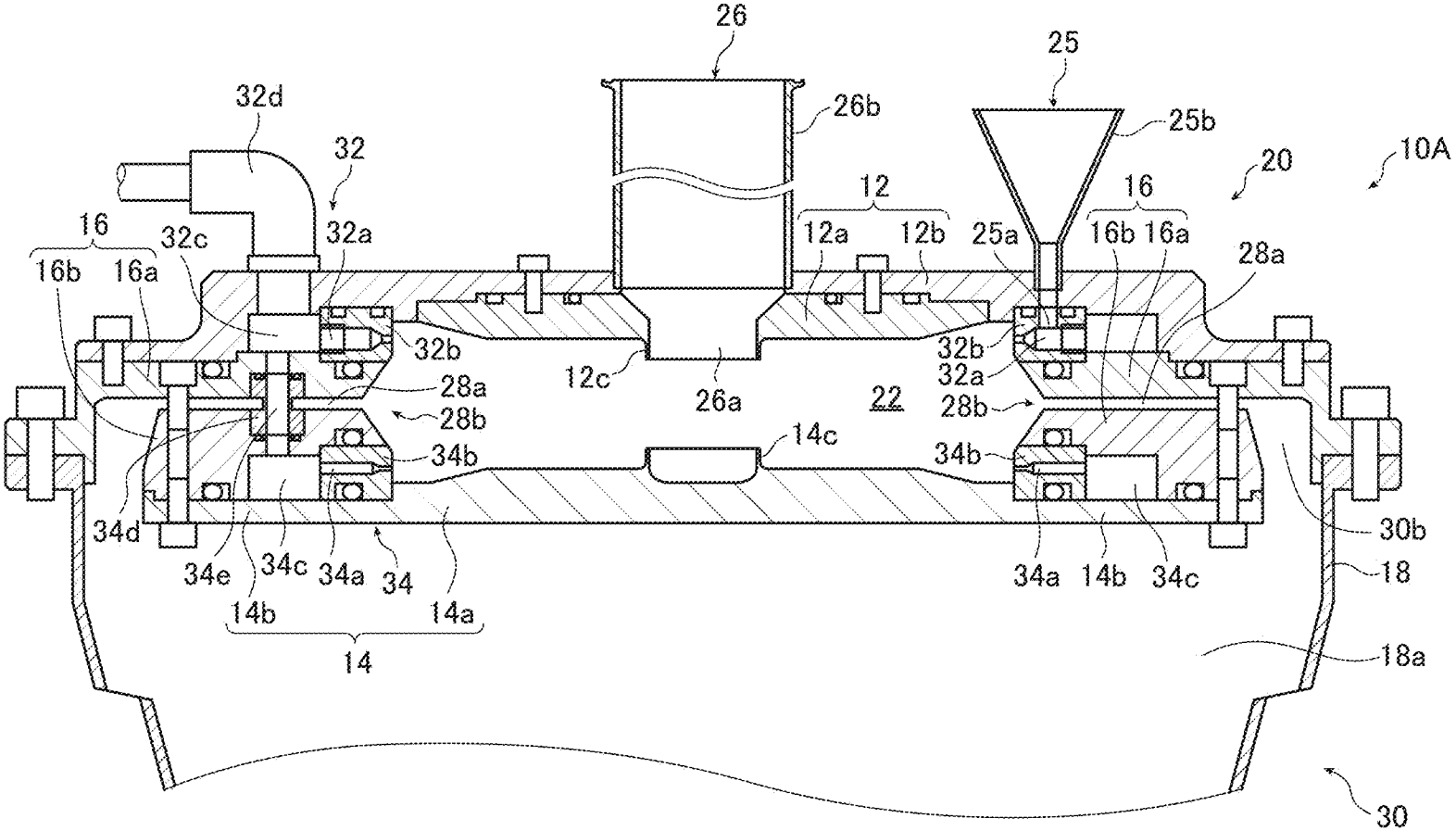
FIG. 3 is a cross-sectional view schematically showing another exemplary configuration of the powder classifying apparatus according to the embodiment of the invention.

The present invention may be configured so that a slit-type annular opening 28*a* formed between the upper and lower peripheral wall members 16*a* and 16*b* of the peripheral wall member 16 has a taper shape that widens toward the disc-like cavity serving as the centrifuge chamber 22 as is seen in a powder classifying apparatus 10A in FIG. 3. In other words, the degree of opening of an entrance 28*b* of the slit-type annular opening 28*a* or the degree of opening of the annular opening 28*a* at its one end on the centrifuge chamber 22 side may be increased.

In the powder classifying apparatus 10A, coarse powder of large size can be moved to the slit-type annular opening 28*a* and drawn out of the centrifuge chamber 22 further smoothly, and thus the coarse powder can be smoothly taken out from the centrifuge chamber 22 serving as the classifying site.

In the present invention, while powder is evenly supplied from the six powder supply ports 24*a* into the centrifuge chamber 22 as described with regard to the powder supply section 24 of the powder classifying apparatus 10 shown in FIGS. 1 and 2(A), the present invention is not limited thereto and powder may be conveyed by air flow through a powder supply section 25 having a powder supply port 25*a* opening toward one of the first air nozzles 32*a* of the nozzle member 32*b* and supplied into the centrifuge chamber 22 in a manner of using an ejector, as in the powder classifying apparatus 10A shown in FIG. 3.

The powder supply section 25 is composed of a hopper 25*b* having the powder supply port 25*a* at the lower end and storing powder. Powder in the hopper 25*b* is supplied, together with compressed air, from the powder supply port 25*a* at the lower end into the centrifuge chamber 22 by an ejector effect that occurs owing to compressed air in the first air nozzle 32*a*. In the illustrated example, the powder supply section 25 is composed of the single hopper 25*b* having the single power supply port 25*a* but may be composed of a plurality of, e.g., six hoppers.

While the fine powder collecting section 26 of the powder classifying apparatus 10 in FIG. 1 is composed of a straight pipe having the same diameter as that of the fine powder collecting port 26*a*, the present invention is not limited thereto and the fine powder collecting section 26 may be constituted of a portion having an inner diameter increasing to a diameter larger than the inner diameter of the fine powder collecting port 26*a* and a straight pipe portion having a large inner diameter as in the powder classifying apparatus 10A shown in FIG. 3.

The powder classifying apparatus according to the first embodiment of the invention is basically configured as above.

Next, the operation of the powder classifying apparatus according to the first embodiment of the invention is described below.

First, the suction blower 92 (see FIG. 7) sucks air with a predetermined air volume from the inside of the centrifuge chamber 22 through the fine powder collecting port 26*a* of the fine powder collecting section 26, and compressed air is supplied from the compressed air supply source 82 (see FIG. 7) to each of the six first air nozzles 32*a* and each of the six second air nozzles 34*a* of the first and second air introducing sections 32 and 34, whereby symmetrical whirling gas streams are generated at the upper and lower portions in the centrifuge chamber 22 and consequently, a whirling gas stream is generated in the whole centrifuge chamber 22.

Under this condition, powder having a particle size distribution as conveyed by air flow from the distributor (see FIG. 7) is supplied through the six powder supply ports 24*a* of the powder supply section 24 at a predetermined flow rate, and subsequently, the powder is supplied, together with air, from an obliquely upward position to the upper portion in the centrifuge chamber 22 in the same direction as the whirling direction of the whirling gas stream, is exposed to the whirling gas stream to exhibit whirling motion, and whirls with the whirling gas stream in the centrifuge chamber 22.

Since the whirling gas streams which are vertically symmetrical to each other are generated in the centrifuge chamber 22 by ejection of compressed air from the first and second air nozzles 32*a* and 34*a*, the powder is, while whirling, affected by centrifugal action in the centrifuge chamber 22.

As a result, fine powder having a size not larger than a classification point is sucked and discharged together with an air stream through the fine powder collecting port 26*a* by the aid of the ring-shaped edge portions 12*c* and 14*c* formed at the central part of the whirl in the centrifuge chamber 22, and collected by the appropriate fine powder collecting filter 90 (see FIG. 7) such as a bag filter. Thus, the fine powder can be sorted from the powder having a particle size distribution and collected. The thus collected fine powder scarcely contains coarse powder having a particle size larger than the classification point.

On the other hand, coarse powder having a diameter larger than the classification point is affected by a large centrifugal force, is therefore smoothly moved radially outward of the whirling gas stream, smoothly enters the slit-type annular opening 28 of the coarse powder collecting section 30 formed at the middle, in the vertical direction, of the centrifuge chamber 22, passes the space 30*b* and the internal space 18*a* of the cone member 18, and is discharged through the coarse powder collecting port 30*a* to be collected.

The remaining powder having not been discharged through the fine powder collecting port 26*a* or the slit-type annular opening 28 moves down to the lower portion in the centrifuge chamber 22. Since the remaining powder often contains not only coarse powder having a diameter larger than the classification point but also fine powder having a diameter not larger than the classification point, the powder joins the whirling gas stream generated by ejection of compressed air from the second air nozzles 34*a* to be moved up to the upper portion in the centrifuge chamber 22 and is affected by centrifugal action, whereby coarse powder and fine powder are efficiently separated by a centrifugal force, and the fine powder is discharged through the fine powder collecting port 26*a* to be collected while the coarse powder enters the slit-type annular opening 28 and is discharged through the coarse powder collecting port 30*a* to be collected, as described above.

For classification with a lower classification point, that is, for sorting out finer particles, it is necessary to increase the speed of a whirling gas stream (whirl) generated in the centrifuge chamber. In the conventional powder classifying apparatus using the guide vanes as described in Patent Literature 1, it is possible to sort out finer particles by forcibly causing a high flow rate of air to enter the centrifuge chamber through air nozzles for use in powder dispersion which are disposed at an upper portion of the centrifuge chamber. In this case, however, an upper whirling gas stream (whirl) generated through the air nozzles and a whirling gas stream (whirl) generated through the guide vanes in the centrifuge chamber greatly differ from each other in speed, in other words, a nonuniform whirling gas stream having different speeds is generated in the centrifuge chamber. Consequently, as shown in FIGS. 8(C) and 8(D), powder is adhered to the bottom surface of the upper disc-like member and the top surface of the lower disc-like member, and the amount of adhered powder increases with increasing speed difference. In addition, since such a nonuniform whirling gas stream is generated in the centrifuge chamber, the classification accuracy is deteriorated and therefore, it is difficult to accurately sort out submicron particles having a size smaller than, for example, 1 μm.

Furthermore, in the conventional powder classifying apparatuses described in Patent Literatures 1 and 2, powder is supplied through a single powder supply port from above to fall in the vertical direction with respect to a whirling gas stream in the centrifuge chamber. Therefore, even though the powder is dispersed by an upper whirling gas stream generated through the air nozzles, a whirling gas stream for classification in the centrifuge chamber is disturbed and as a result, a nonuniform whirling gas stream having different speeds is generated in the centrifuge chamber, leading to the adhesion of powder to the bottom surface of the upper disc-like member and deterioration of classification accuracy.

Furthermore, in the conventional powder classifying apparatuses described in Patent Literatures 1 and 2, applied is a method of causing coarse powder to fall to a lower peripheral portion in the centrifuge chamber to collect the coarse powder, and in order to enhance the classification efficiency, powder containing fine powder as fallen to a powder reclassifying zone located at the lower peripheral portion in the centrifuge chamber is returned to the centrifuge chamber by air nozzles. Accordingly, coarse powder (coarse particles) stays near the top surface of the lower disc-like member due to air blown through these air nozzles, leading to the adhesion of powder as well as uneven adhesion.

In contrast, in the powder classifying apparatus 10 in the first embodiment, no guide vanes are used, the first and second air introducing sections 32 and 34 respectively including the first and second air nozzles 32*a* and 34*a* are provided at the upper and lower portions of the annular peripheral wall member 16 in the circumferential direction at the outer peripheral portion of the centrifuge chamber 22 of substantially disc-like shape, and a high flow rate of compressed air is forcibly caused to enter through the first and second air nozzles 32*a* and 34*a* to generate high flow rates of symmetrical whirling gas streams at the upper and lower portions in the centrifuge chamber 22 to thereby generate a uniform whirling gas stream in the centrifuge chamber 22; a slit-type annular opening 28 is provided at the middle, in the vertical direction, of the annular peripheral wall member 16 to take out coarse powder from the side of the centrifuge chamber 22 to thereby smoothly discharge the coarse powder from the centrifuge chamber 22 serving as the classifying site; and powder conveyed by air flow through the evenly-arranged powder supply ports is supplied from an obliquely upward position with respect to the whirling gas stream in the centrifuge chamber 22 so as to move along the whirling direction of the whirling gas stream, thereby suppressing and minimizing the disturbance of the whirling gas stream in the centrifuge chamber 22.

In particular, since the whirling gas stream in the centrifuge chamber 22 is uniform and flows at a high flow rate, as shown in FIGS. 8 (A) and (B), this configuration prevents the adhesion of powder to the bottom surface of the upper disc-like member or the top surface of the lower disc-like member and the deterioration of classification accuracy, whereby submicron particles can be accurately and stably sorted out.

With the powder classifying apparatus in this embodiment, fine particles such as submicron particles can be efficiently sorted out despite its tendency to cohere. Examples of classifiable powders include various types of powders ranging from low specific gravity powders such as silica powder and toners to high specific gravity powders such as powders of metals and alumina.

In addition, since a movable member such as guide vanes is not used, a compact powder classifying apparatus can be attained.

Next, an exemplary configuration of a powder classifying apparatus according to another embodiment of the invention is described.

Figure 4:
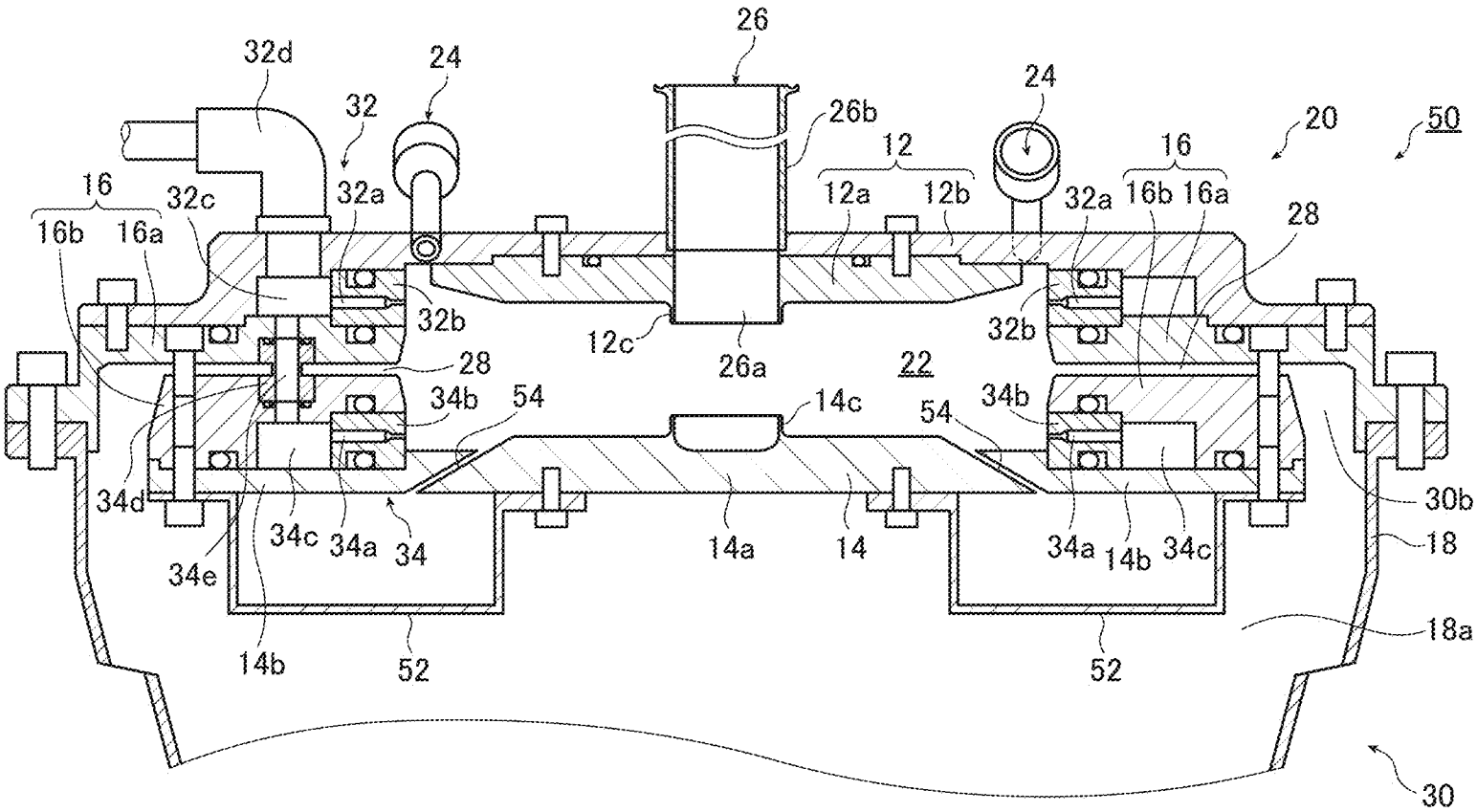
FIG. 4 is a cross-sectional view schematically showing a configuration of a powder classifying apparatus according to another embodiment of the invention.

FIG. 4 is a cross-sectional view schematically showing a powder classifying apparatus according to a second embodiment of the invention.

A powder classifying apparatus 50 in the embodiment as shown in FIG. 4 has the same configuration as that of the powder classifying apparatus 10 shown in FIG. 1 except having an annular collecting container 52 at the bottom surface of the lower disc-like member 14, and the same constituent elements are assigned by the same reference signs and will not be explained. Different points are mainly described.

As compared to the powder classifying apparatus 10 shown in FIG. 1, the powder classifying apparatus 50 shown in FIG. 4 further includes the annular collecting container 52 which serves as an intermediate powder collecting section for collecting, from coarse powder having a size larger than a classification point (particle size) for fine powder, intermediate powder having a size not larger than a second classification point (particle size) which is larger than the classification point for fine powder, i.e., a first classification point (particle size).

The annular collecting container 52 is provided on the bottom surface (underside) of an annular region bridging the inner and outer edge portions 14*a* and 14*b* of the lower disc-like member 14. An annular inclined opening 54 is provided at the inner edge portion 14*a* to allow the inside of the centrifuge chamber 22 to communicate with the inside of the collecting container 52. The inclined opening 54 is a groove-shaped discharge path that is inclined toward the outer periphery (in the radial direction) from the position which is located on the lower disc-like member 14 on the side facing the centrifuge chamber 22 and which corresponds to a point where the slope of the inner portion 12*a* of the upper disc-like member 12 starts toward the outer periphery, and that then reaches the inside of the collecting container 52 to thereby allow the collecting container 52 to communicate with an inner side of the outer edge portion 14*b*.

Powder supplied into the centrifuge chamber 22 is centrifuged from the central part of a whirling gas stream toward the outer peripheral portion thereof and separated according to the particle size by the whirling gas stream in the centrifuge chamber 22. Consequently, the powder is separated into fine powder with a small particle size which goes to the central part of the whirling gas stream, coarse powder with a large particle size, such as coarse particles, which goes to the outer peripheral portion of the whirling gas stream, and coarse powder with an intermediate particle size which goes to a region between the central part and the outer peripheral portion of the whirling gas stream.

As a result, the fine powder with a size not larger than the predetermined particle size (first particle size) is discharged, together with sucked air, from the central part of the whirling gas stream through the fine powder collecting port 26*a*, and the coarse powder with a size larger than the second particle size, such as coarse particles, is easily discharged from the outer peripheral portion of the whirling gas stream through the slit-type annular opening 28 by a centrifugal force. The coarse powder with an intermediate particle size which is larger than the first particle size but smaller than the particle size of the coarse powder having a size larger than the second particle size, i.e., intermediate powder is to be discharged from the outer peripheral portion of the whirling gas stream through the slit-type annular opening 28 by a centrifugal force at the end. However, the intermediate powder may be caused to repeatedly fall to the top surface of the lower disc-like member 14 and again float by air ejected by the second air nozzles 34*a*, and accordingly stay in the centrifuge chamber 22 for longer periods of time compared to the fine powder and the coarse powder having a size larger than the second particle size, hampering the improvement of powder classification efficiency.

To cope with it, there is provided the collecting container 52 having the inclined opening 54 located at the annular region where the intermediate powder is prone to gather, whereby the intermediate powder, which is prone to gather in the centrifuge chamber 22, is aggressively collected to the collecting container 52 through the inclined opening 54 when falling to the top surface of the lower disc-like member 14. This configuration enables the classification of powder newly supplied, further improving powder classification efficiency.

The collecting container 52 having the inclined opening 54 constitutes a second collecting section of the invention.

With this configuration, the powder classifying apparatus 50 in the second embodiment of the invention can accurately sort out fine powder over long periods of time without allowing powder to adhere to a wall surface of the centrifuge chamber 22, particularly to an upper or lower wall surface thereof.

The powder classifying apparatus 50 in this embodiment may also be provided with, instead of the slit-type annular opening 28, the slit-type annular opening 28*a* having a taper shape that widens toward the centrifuge chamber 22 as in the powder classifying apparatus 10A shown in FIG. 3.

Next, an exemplary configuration of a powder classifying apparatus according to still another embodiment of the invention is described.

Figure 5:
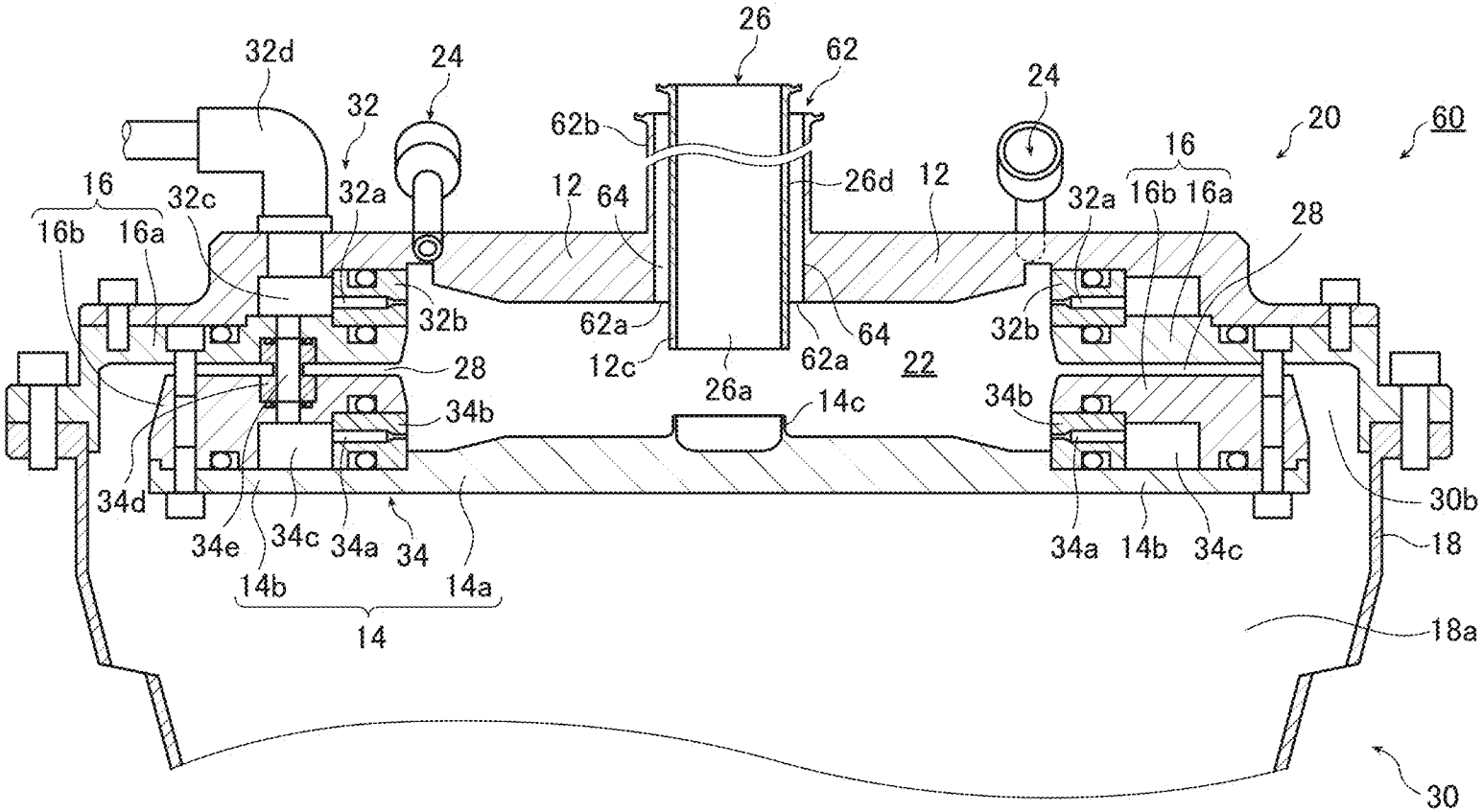
FIG. 5 is a cross-sectional view schematically showing a configuration of a powder classifying apparatus according to still another embodiment of the invention.

FIG. 5 is a cross-sectional view schematically showing a powder classifying apparatus according to a third embodiment of the invention.

A powder classifying apparatus 60 in the embodiment shown in FIG. 5 has the same configuration as that of the powder classifying apparatus 10 shown in FIG. 1 except having an intermediate powder collecting section 62 at the outside of the fine powder collecting section 26 at the center of the upper disc-like member 12, and the same constituent elements are assigned by the same reference signs and will not be explained. Different points are mainly described.

As compared to powder classifying apparatus 10 shown in FIG. 1, the powder classifying apparatus 60 shown in FIG. 5 includes the upper disc-like member 12 of integral type and the fine powder collecting section 26 which has an end portion being a ring-shaped edge 12*c* projecting toward the centrifuge chamber 22 at the center of the upper disc-like member 12 and which is composed of an inner tube (inner cylindrical tube) 26*d* constituting the fine particle collecting port 26*a*, and further includes, at the outside of the fine particle collecting port 26*a* of the fine particle collecting section 26, the intermediate powder collecting section 62 composed of an opening 64 of the upper disc-like member 12 and an outer tube (outer cylindrical tube) 62*b*, the opening 64 constituting an intermediate powder collecting port 62*a* for collecting intermediate powder having a size not larger than the above-described second classification point (particle size).

The outer tube 62*b* of the intermediate powder collecting section 62 is connected to extend from the opening 64 of the upper disc-like member 12 so as to have the same diameter as that of the opening 64, and constitutes a double tube together with the inner tube 26*d* of the fine powder collecting section 26. The intermediate powder collecting port 62*a* of the intermediate powder collecting section 62 is formed between the inner surface of the central opening 64 of the upper disc-like member 12 and the outer tube 62*b* and the outer surface of the inner tube 26*d* being the fine powder collecting port 26*a* of the fine powder collecting section 26. The end of the intermediate powder collecting port 62*a* is constituted by the central opening 64 of the upper disc-like member 12 and positioned above an opening at the end of the inner tube 26*d* being the fine powder collecting port 26*a* of the fine powder collecting section 26. In other words, the end of the inner tube 26*d* being the fine powder collecting port 26*a* projects beyond the end of the intermediate powder collecting port 62*a* toward the centrifuge chamber 22 and forms the ring-shaped edge 12*c*.

The intermediate powder collecting port 62*a* is connected to a suction blower (not shown) via an appropriate intermediate powder collecting filter (not shown) such as a bag filter, as with the fine powder collecting port 26*a*.

As described above, intermediate powder which is prone to gather in a whirling gas stream in the region between the central part and the outer peripheral portion of a whirling gas stream is collected together with sucked air through the intermediate powder collecting port 62*a*. This configuration enables the classification of powder newly supplied, further improving powder classification efficiency.

Thus, the powder classifying apparatus 60 in the third embodiment of the invention can accurately sort out fine powder over long periods of time without allowing powder to adhere to a wall surface of the centrifuge chamber 22, particularly to an upper or lower wall surface thereof, as with the powder classifying apparatus 50 in the second embodiment described above.

The powder classifying apparatus 60 in this embodiment may also be provided with, instead of the slit-type annular opening 28, the slit-type annular opening 28*a* having a taper shape that widens toward the centrifuge chamber 22 as in the powder classifying apparatus 10A shown in FIG. 3, the annular collecting container 52 for collecting intermediate powder as in the power classifying apparatus 50 shown in FIG. 4, or both thereof.

Next, an exemplary configuration of a powder classifying apparatus according to still another embodiment of the invention is described.

Figure 6:
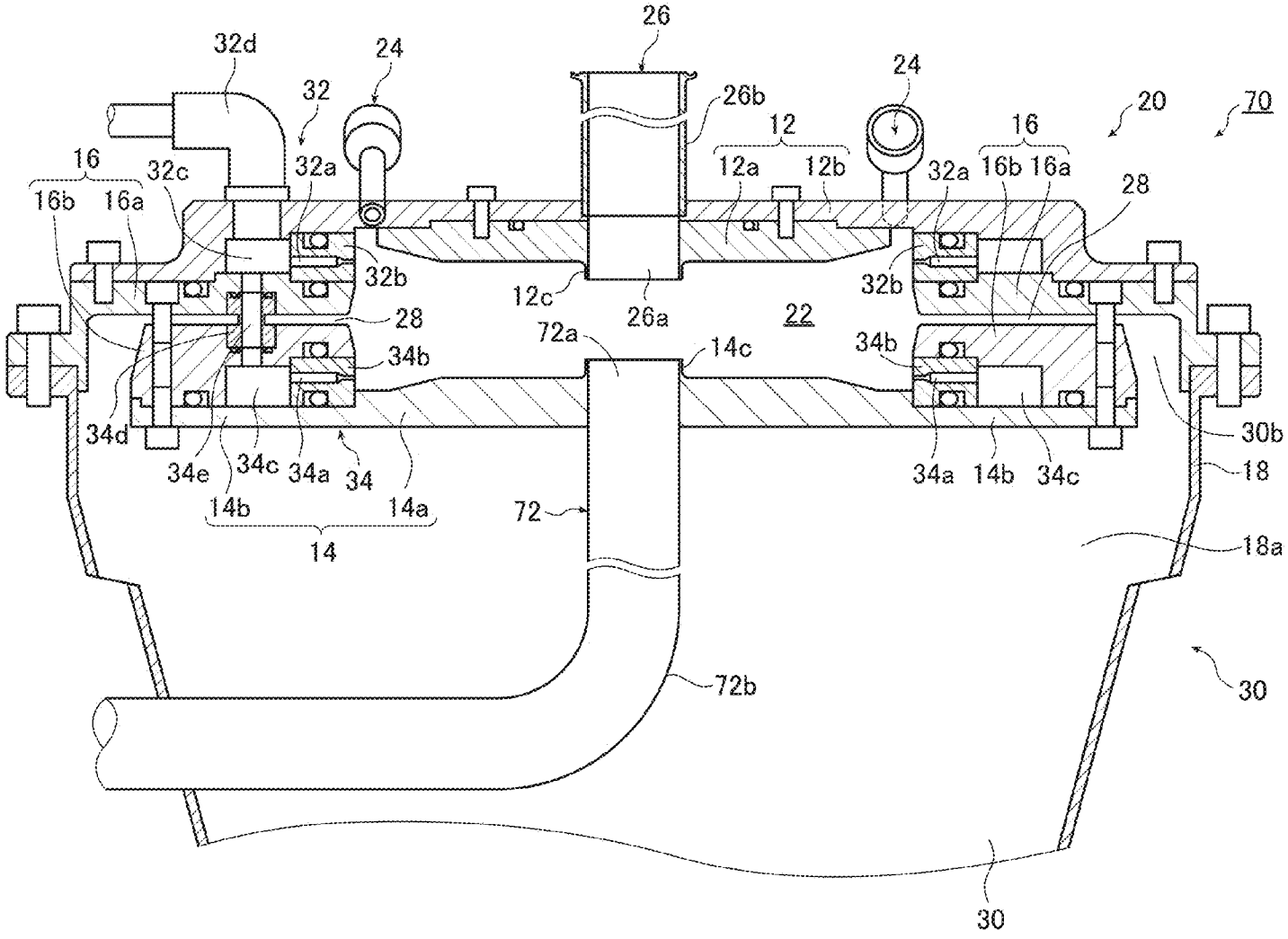
FIG. 6 is a cross-sectional view schematically showing a configuration of a powder classifying apparatus according to still another embodiment of the invention.

FIG. 6 is a cross-sectional view schematically showing a powder classifying apparatus according to a fourth embodiment of the invention.

A powder classifying apparatus 70 in the embodiment shown in FIG. 6 has the same configuration as that of the powder classifying apparatus 10 shown in FIG. 1 except having a second fine powder collecting section 72 located at the center of the lower disc-like member 14 to correspond to the fine powder collecting section 26 at the center of the upper disc-like member 12, and the same constituent elements are assigned by the same reference signs and will not be explained. Different points are mainly described.

As compared to the powder classifying apparatus 10 shown in FIG. 1, the powder classifying apparatus 70 shown in FIG. 6 includes the second fine powder collecting section 72 having a second fine powder collecting port 72*a* at the center of the inner edge portion 14*a* of the lower disc-like member 14 to be symmetrical to the fine powder collecting port 26*a* of the fine powder collecting section 26 at the center of the upper disc-like member 12. Needless to say, the end of an opening portion of the fine powder collecting port 72*a* projects toward the centrifuge chamber 22 and forms the ring-shaped edge 14*c*.

While the fine powder collecting port 72*a* of the second fine powder collecting section 72 on the lower side of the centrifuge chamber 22 is symmetrical to the fine powder collecting port 26*a* of the fine powder collecting section 26 on the upper side of the centrifuge chamber 22, an opening constituting the second fine powder collecting port 72*a* at the center of the inner edge portion 14*a* of the lower disc-like member 14 is connected to an extension cylindrical tube 72*b*. The extension cylindrical tube 72*b* extends vertically downward, then is bent and horizontally extends outward of the cone member 18, and is finally connected to, for instance, the suction blower 92 through the filter 90.

Thus, the fine powder collecting port 26*a* and the second fine powder collecting port 72*a* are arranged to be symmetrical with respect to the centrifuge chamber 22. This configuration enhances symmetry properties of upper and lower whirling gas streams in the centrifuge chamber 22 and accordingly, a more uniform whirling gas stream can be achieved in the whole centrifuge chamber 22.

As a result, the powder classifying apparatus 70 in the fourth embodiment of the invention can accurately sort out fine powder over long periods of time without allowing powder to adhere to a wall surface of the centrifuge chamber 22, particularly to an upper or lower wall surface thereof.

The powder classifying apparatus 70 in this embodiment may also be provided with, instead of the slit-type annular opening 28, the slit-type annular opening 28*a* having a taper shape that widens toward the centrifuge chamber 22 as in the powder classifying apparatus 10A shown in FIG. 3, at least one of the annular collecting container 52 and the intermediate powder collecting section 62 for collecting intermediate powder as in the power classifying apparatuses 50 and 60 shown in FIGS. 4 and 5, or all thereof.

The various powder classifying apparatuses in the embodiments of the invention described above can each constitute a classifying system shown in FIG. 7.

FIG. 7 is a schematic view showing a configuration of a whole classifying system using any of the powder classifying apparatuses of the invention.

The classifying system 80 shown in the drawing includes the powder classifying apparatus 10 in the first embodiment shown in FIG. 1, the compressed air supply source 82 for supplying compressed air to the pluralities of air nozzles 32*a* and 34*a* of the air introducing sections 32 and 34 of the powder classifying apparatus 10, the distributor 84 for conveying, by air flow, powder to be classified to the powder supply ports 24*a* of the powder supply section 24 of the powder classifying apparatus 10, a screw feeder 86 for supplying the powder to the distributor 84, a compressed air supply source 88 for supplying compressed air used by the distributor 84 to convey by air flow the powder supplied from the screw feeder 86, the fine powder collecting filter 90 such as a bag filter for collecting fine powder discharged through the fine powder collecting port 26*a* of the fine powder collecting section 26 of the powder classifying apparatus 10, the suction blower 92 for sucking air containing fine powder through the fine powder collecting port 26*a*, an orifice 94 disposed between the filter 90 and the suction blower 92 to measure the flow rate of air sucked by the suction blower 92, a display 96 for displaying the air flow rate measured at the orifice 94, and piping that constitutes pipelines interconnecting these components.

In the classifying system 80, firstly, compressed air is supplied from the compressed air supply source 82 to the air nozzles 32*a* and 34*a* of the air introducing sections 32 and 34 of the powder classifying apparatus 10 through the piping so that the compressed air is ejected into the centrifuge chamber 22 of the powder classifying apparatus 10 whereby symmetrical whirling gas streams are separately generated in the upper and lower portions to generate a uniform whirling gas stream in the whole centrifuge chamber 22.

Secondly, compressed air is supplied from the compressed air supply source 88 to an ejector 84*a* of the distributor 84 through the piping while powder is supplied from the screw feeder 86 to the distributor 84 so that the powder joins the compressed air ejected from the ejector 84*a* to be conveyed by air flow through the piping, and the powder conveyed by air flow is supplied to the powder supply ports 24*a* of the powder supply section 24 of the powder classifying apparatus 10 and ejected from an obliquely upward position toward the whirling gas stream in the centrifuge chamber 22 so as to move along the whirling direction of the whirling gas stream.

The powder ejected into the centrifuge chamber 22 together with air is centrifuged by the whirling gas stream in the centrifuge chamber 22. Fine powder is sucked together with air by the suction blower 92 through the fine powder collecting port 26*a* of the fine powder collecting section 26 of the powder classifying apparatus 10 and the piping, and then collected by the filter 90.

On the other hand, coarse powder is discharged through the slit-type annular opening 28 of the coarse powder collecting section 30 of the powder classifying apparatus 10, passes the space 30*b* and the internal space 18*a* of the cone member 18, and is collected through the coarse powder collecting port 30*a*.

EXAMPLE

The powder classifying apparatus of the invention is specifically described below based on an example.

For the example, a classification test was carried out by supplying metal powder having a median diameter of up to 1 μm in an amount of 1 kg/h in the classifying system 80 shown in FIG. 7 employing the powder classifying apparatus 10 shown in FIG. 1.

The disc-like cavity of the centrifuge chamber 22 of the powder classifying apparatus 10 had a diameter of 174 mm.

The powder was supplied evenly through the six powder supply ports 24*a* into the centrifuge chamber 22 from an obliquely upward position with respect to a whirling gas stream. The powder supply was 1 kg/h as a whole.

The amount of air sucked by the suction blower 92 was 2.5 $m^3$/min, the ejection pressure of each of the upper and lower air nozzles 32*a* and 34*a* was 0.58 MPa, and the ejection rate thereof was 430 L/min.

After the metal powder classification test carried out for 1 hour, the bottom surface of the upper disc-like member 12 (inner member) and the top surface of the lower disc-like member 14 were inspected.

Figure 8A:
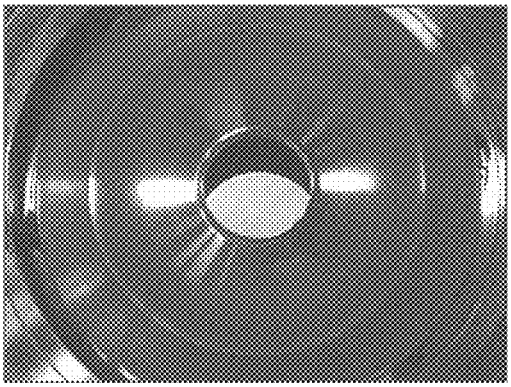
FIGS. 8(A) and 8(B) are photographs substituted for drawings showing the states of upper and lower disc-like members of the powder classifying apparatus of the invention and FIGS. 8(C) and 8(D) are those of the conventional powder classifying apparatus.
Figure 8B:
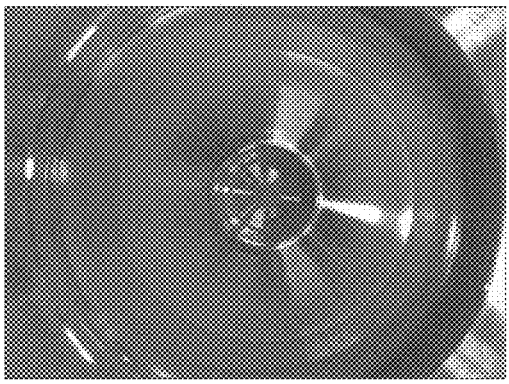
Figure 8C:
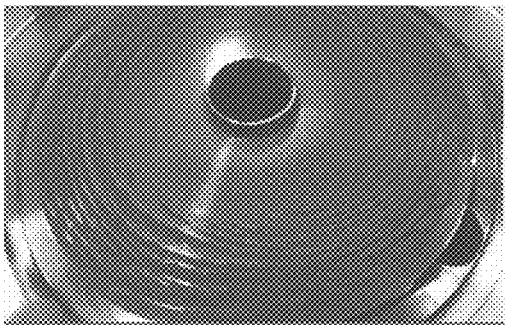
Figure 8D:
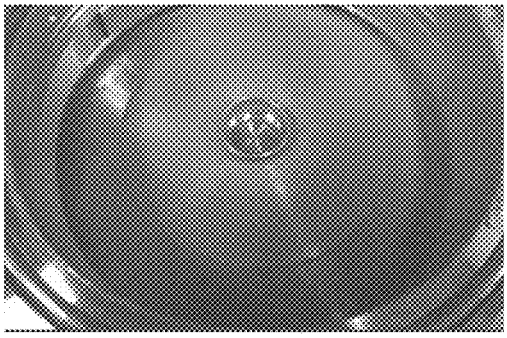

As a result, no adhesion of powder on the bottom surface of the upper disc-like member 12 and the top surface of the lower disc-like member 14 was found at all as shown in FIGS. 8(A) and 8(B).

For a comparative example, a classification test was carried out by supplying metal powder having a median diameter of up to 1 μm in an amount of 1 kg/h in the classifying system 80 shown in FIG. 7 employing a powder classifying apparatus shown in FIG. 1 of Patent Literature 1 in place of the powder classifying apparatus 10 shown in FIG. 1.

A disc-like cavity of a centrifuge chamber of the powder classifying apparatus had a diameter of 174 mm.

The powder was supplied into the centrifuge chamber through a single powder supply port from above to naturally fall in the vertical direction with respect to a whirling gas stream in the centrifuge chamber. The powder supply was 1 kg/h.

The amount of air sucked by a suction blower was 2.0 $m^3$/L/min; the ejection pressure and the ejection rate of each upper air nozzle for dispersing powder were respectively 0.65 MPa and 510 L/min, the ejection pressure and the ejection rate of each lower air nozzle for reclassification were respectively 0.5 MPa and 180 L/min, and the amount of air entering through guide vanes was 100 L/min.

After the metal powder classification test carried out for 1 hour, the bottom surface of an upper disc-like member and the top surface of a lower disc-like member were inspected.

As a result, it was seen that a considerable amount of powder was adhered to the upper disc-like member as shown in FIG. 8(C). It was also seen that powder was slightly adhered to the top surface of the lower disc-like member as shown in FIG. 8(D)

From the foregoing results, the effects of the invention are apparent.

The embodiments and examples described above each illustrate one example of the invention and the invention is not limited thereto. It should be understood that various improvements and modifications are possible without departing from the scope and spirit of the invention.

REFERENCE SIGNS LIST

10, 10A, 50, 60, 70 powder classifying apparatus
12 upper disc-like member
12*c*, 14*c* ring-shaped edge
14 lower disc-like member
16 peripheral wall member
18 cone member
20 casing
22 centrifuge chamber
24, 25 powder supply section
24*a*, 25*a* powder supply port
26, 72 fine powder collecting section
26*a*, 72*a* fine powder collecting port
28, 28*a* slit-type annular opening
30 coarse powder collecting section
30*a* coarse powder collecting port
32, 34 air introducing section
32*a*, 34*a* air nozzle
52 annular collecting container
62 intermediate powder collecting section
62*a* intermediate powder collecting port

The invention claimed is:

1. A powder classifying apparatus for classifying powder having a particle size distribution to collect fine powder having a size not larger than a predetermined particle size, comprising:

a casing including two disk members arranged to be spaced apart at a predetermined interval and a peripheral wall member attached on outer peripheral sides of the two disk members, the casing having therein a disk cavity formed between the two disk members and at an inner side of the peripheral wall member, the disk cavity being a place where the powder is classified by a whirling gas stream generated therein;

one or more powder supply ports disposed at an outside of at least one of the two disk members of the casing so as to communicate with an inner side of an outer edge portion of the disk cavity, and configured to supply the powder conveyed by air flow into the disk cavity;

a discharge section formed at at least one of the two disk members of the casing so as to communicate with a central portion, in a radial direction, of the disk cavity, and configured to discharge air containing the fine powder to be discharged from the disk cavity;

a collecting section formed at a middle portion, in a thickness direction, of the peripheral wall member of the casing so as to communicate with the outer edge portion of the disk cavity, and including a slit-type opening provided to collect coarse powder having a size larger than the predetermined particle size to be discharged from the disk cavity; and two air introducing sections separately provided at opposite sides, in the thickness direction, of the slit-type opening of the peripheral wall member of the casing, each including a plurality of air introducing devices arranged at the peripheral wall member of the casing at the outer edge portion of the disk cavity to extend along tangential directions of the outer edge portion, the plurality of air introducing devices being configured to introduce air into the disk cavity to generate the whirling gas stream in the disk cavity.

2. The powder classifying apparatus according to claim 1, wherein the two disk members comprise an upper disk member and a lower disk member, and the powder classifying apparatus further including a second collecting section formed at at least one of the two disk members of the casing so as to communicate with the disk cavity, the second collecting section being configured to collect a part of the coarse powder discharged from the disk cavity.

3. The powder classifying apparatus according to claim 2, wherein the discharge section is composed of an inner cylindrical tube standing upright through the upper disk member of the casing and having an end projecting toward an inside of the disk cavity, wherein the second collecting section is composed of an outer cylindrical tube with a diameter larger than that of the inner cylindrical tube, the outer cylindrical tube standing upright through the upper disk member of the casing and being disposed coaxially with the inner cylindrical tube, and wherein an end of the outer cylindrical tube is positioned above the end of the inner cylindrical tube and communicates with the disk cavity.

4. The powder classifying apparatus according to claim 2, wherein the second collecting section includes a groove-shaped discharge path formed at a lower side of the lower disk member of the casing so as to communicate with the inner side of the outer edge portion of the disk cavity.

5. The powder classifying apparatus according to claim 1, wherein the slit-type opening of the collecting section has a taper shape that widens toward the disk cavity.

6. The powder classifying apparatus according to claim 1, wherein the discharge section is provided at each of the two disk members of the casing.

7. The powder classifying apparatus according to claim 1, further including a ring-shaped edge disposed at a center of at least one of opposing inner surfaces of the two disk members of the casing, the opposing inner surfaces constituting an upper surface and a lower surface of the disk cavity.

8. The powder classifying apparatus according to claim 1, wherein the powder supply ports are evenly arranged at the upper disk member of the two disk members of the casing and are inclined toward the inner side of the outer edge portion of the disk cavity along a whirling direction of the whirling gas stream, and wherein the powder is conveyed by air flow generated by an ejector, and ejected and supplied with the air flow from the powder supply ports into the disk cavity in the whirling direction of the whirling gas stream.

9. The powder classifying apparatus according to claim 1, wherein the powder to be conveyed by air flow is distributed in advance by a distributor to a plurality of pipelines each connected to each of the powder supply ports by aid of compressed air.

10. The powder classifying apparatus according to claim 1, wherein the powder supply port opens to an inside of one of the air introducing devices of one of the two air introducing sections, and wherein the powder is conveyed by air flow by an ejector effect that occurs owing to air introduced by the one of the air introducing devices and is supplied to the disk cavity.

11. The powder classifying apparatus according to claim 1, wherein each of the air introducing devices is an air nozzle for use in injecting compressed air into the disk cavity.

* * * * *